US007184028B2

(12) United States Patent
Wu et al.

(10) Patent No.: US 7,184,028 B2
(45) Date of Patent: Feb. 27, 2007

(54) SWITCHABLE LCD TOUCHSCREEN PANEL SCAN MODULE

(75) Inventors: Vincent Wu, Irvine, CA (US); Wichan Jarasrattanapaiboon, Fountain Valley, CA (US)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 161 days.

(21) Appl. No.: 10/336,511

(22) Filed: Jan. 3, 2003

(65) Prior Publication Data

US 2004/0133857 A1 Jul. 8, 2004

(51) Int. Cl.
*G09G 5/00* (2006.01)

(52) U.S. Cl. ..... 345/173; 345/156; 345/168; 345/169; 715/773

(58) Field of Classification Search ..... 345/156–173, 345/178, 168–169
See application file for complete search history.

(56) References Cited

U.S. PATENT DOCUMENTS 5,070,467 A * 12/1991 Todome ..... 345/502
5,586,196 A 12/1996 Sussman
5,805,298 A * 9/1998 Ho et al. ..... 358/402
5,917,615 A * 6/1999 Reifman et al. ..... 358/468
6,098,028 A * 8/2000 Zwan et al. ..... 702/120
6,151,426 A 11/2000 Lee et al.
6,157,439 A 12/2000 Rousseau et al.
6,263,122 B1 7/2001 Simske et al.
6,421,509 B1 7/2002 Nomura et al.
6,462,734 B1 * 10/2002 Vachette ..... 345/173
6,480,187 B1 * 11/2002 Sano et al. ..... 345/175
6,621,590 B1 * 9/2003 Livingston ..... 358/1.15
2003/0052865 A1 * 3/2003 Miller ..... 345/173

OTHER PUBLICATIONS

Microsoft Computer Dictionary. 5th ed. Microsoft Press. 2002. "Registry." p. 445-446.*

* cited by examiner

*Primary Examiner*—Richard Hjerpe
*Assistant Examiner*—Duc Q Dinh
(74) *Attorney, Agent, or Firm*—Tucker, Ellis, & West LLP

(57) ABSTRACT

An image processing apparatus comprising a controller, a scanner coupled to the controller, an external video port coupled to the controller, and an external video monitor coupled to the video port. The controller comprising a component object module for communicating between the controller and a user interface to be displayed on the external video monitor. When an image is scanned by the scanner, a scanned image is created, the scanned image is stored by the controller and the component object module causes the scanned image to be displayed on the external monitor. The component object interface receives input from the external monitor and communicates the input to the controller. The scanned image is previewed on one portion of the external monitor while commands may be simultaneously received at another portion of the external monitor.

18 Claims, 12 Drawing Sheets

600

SWITCHABLE LCD TOUCHSCREEN PANEL SCAN MODULE

COPYRIGHT OR MASK WORK NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

BACKGROUND OF THE INVENTION

This invention is directed to an image processing apparatus. More particularly, this invention is directed to an image processing apparatus with a color touchscreen LCD monitor, capable of serving as a user interface or displaying a preview of an image.

Often with a conventional image processing apparatus, it is desirable to edit the document to be copied or scanned. This is done by utilizing the texts and graphics on the copier's screen panel. However, the small size of the copier's embedded panel and its complicated user interfaces are not suitable for non-technology oriented users or people with limited visibility. For example, elderly people who are visually impaired will have trouble reading the texts and graphics from the small LCD screen on the copier. Additionally, people with large pointing fingers will also have trouble touching or selecting the correct button on the copier's small LCD panel. Finally, the copier's small panel is also not suitable for displaying scan images. This hinders a user's ability to correctly and efficiently edit their selected document(s).

Thus, there is a need for an image processing apparatus which overcomes the limitations of the prior art, and allows a scanned imaged to be displayed and edited on a large external touchscreen monitor.

BRIEF SUMMARY OF THE INVENTION

In view of the aforementioned needs, the invention contemplates an image processing apparatus, comprising data input means adapted to receive a document and to generate document data, a user interface adapted to obtain and provide selected information about the document data to an associated user, an external video monitor adapted to display at least one of the user interface and selected document data operatively coupled to the image processing apparatus; and means adapted to communicate between the data input means and the external video monitor such that the at least one of the user interface and the selected document data are displayed on the external video monitor. When an image is scanned by the data input means, a scanned image is created, the scanned image is stored by a controller and a component object module running on the controller causes the scanned image to be displayed on the external monitor. Preferably, the external monitor is an at least 12.1 inch, color LCD touchscreen monitor, and the component object module processing commands input via the touchscreen. In the preferred embodiment, the touchscreen monitor displays an actual depiction of a page of the document in one portion of the screen while being adapted to receive commands from the user interface displayed on another portion of the screen. The apparatus may further comprise an operating system service communicating to the user interface wherein the service posts either a current operating state, a current event or both a current operating state and a current event.

Another aspect of the present invention is a method for processing an image received by an image processing apparatus, the steps comprising: receiving an e-mail address, scanning an image and creating a scanned image, displaying the scanned image on an external touchscreen monitor having a minimum size of 12.1 inches, receiving commands for processing the scanned image from the external touchscreen monitor, and sending the image to the e-mail address. The method may further comprise receiving a password. The commands are selected from the group consisting of edit, insert, print and save. The commands are received by the external touchscreen monitor while simultaneously displaying the scanned image on another portion of the monitor's display. Another aspect of the present invention is a computer computer-readable medium of instructions for implementing the aforementioned method.

While the component object module that communicates between the external monitor and the controller is typically based in software, those skilled in the art can readily appreciate that the component object module may be implemented in either software, hardware, or a combination thereof.

Still other objects of the present invention will become readily apparent to those skilled in this art from the following description wherein there is shown and described a preferred embodiment of this invention, simply by way of illustration of one of the best modes best suited for to carry out the invention. As it will be realized, the invention is capable of other different embodiments and its several details are capable of modifications in various obvious aspects all without from the invention. Accordingly, the drawing and descriptions will be regarded as illustrative in nature and not as restrictive.

BRIEF DESCRIPTION OF THE SEVERAL VIEWS OF THE DRAWING

The accompanying drawings incorporated in and forming a part of the specification, illustrates several aspects of the present invention, and together with the description serve to explain the principles of the invention. In the drawings.

DETAILED DESCRIPTION OF INVENTION

Throughout this description, the preferred embodiment and examples shown should be considered as exemplars, rather than limitations, of the present invention.

Figure 1:
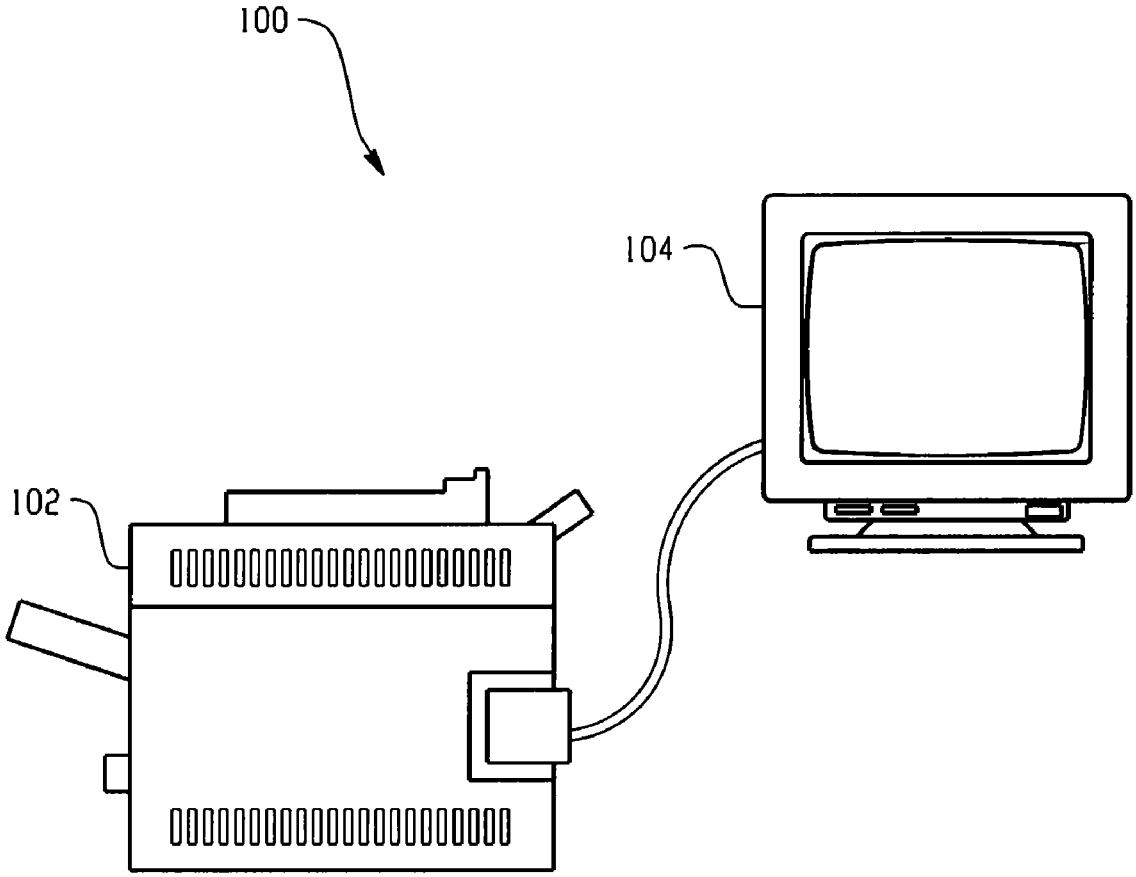
FIG. 1. is a perspective view of the image processing apparatus of the present invention.

The present invention is directed to an image processing apparatus for displaying and editing a scanned image on an external monitor. As shown in FIG. 1, in one embodiment the image processing apparatus, generally designated 100, comprises an external monitor 104 and a copier 102. The external monitor 104 is a color LCD touchscreen monitor, and is at least a 12.1 inch monitor. The external monitor 104 is connected to the copier 102 via VGA and/or serial ports. This allows a user to interact with the copier 102 to do the scanning job on the large color touchscreen monitor 104.

Figure 3:
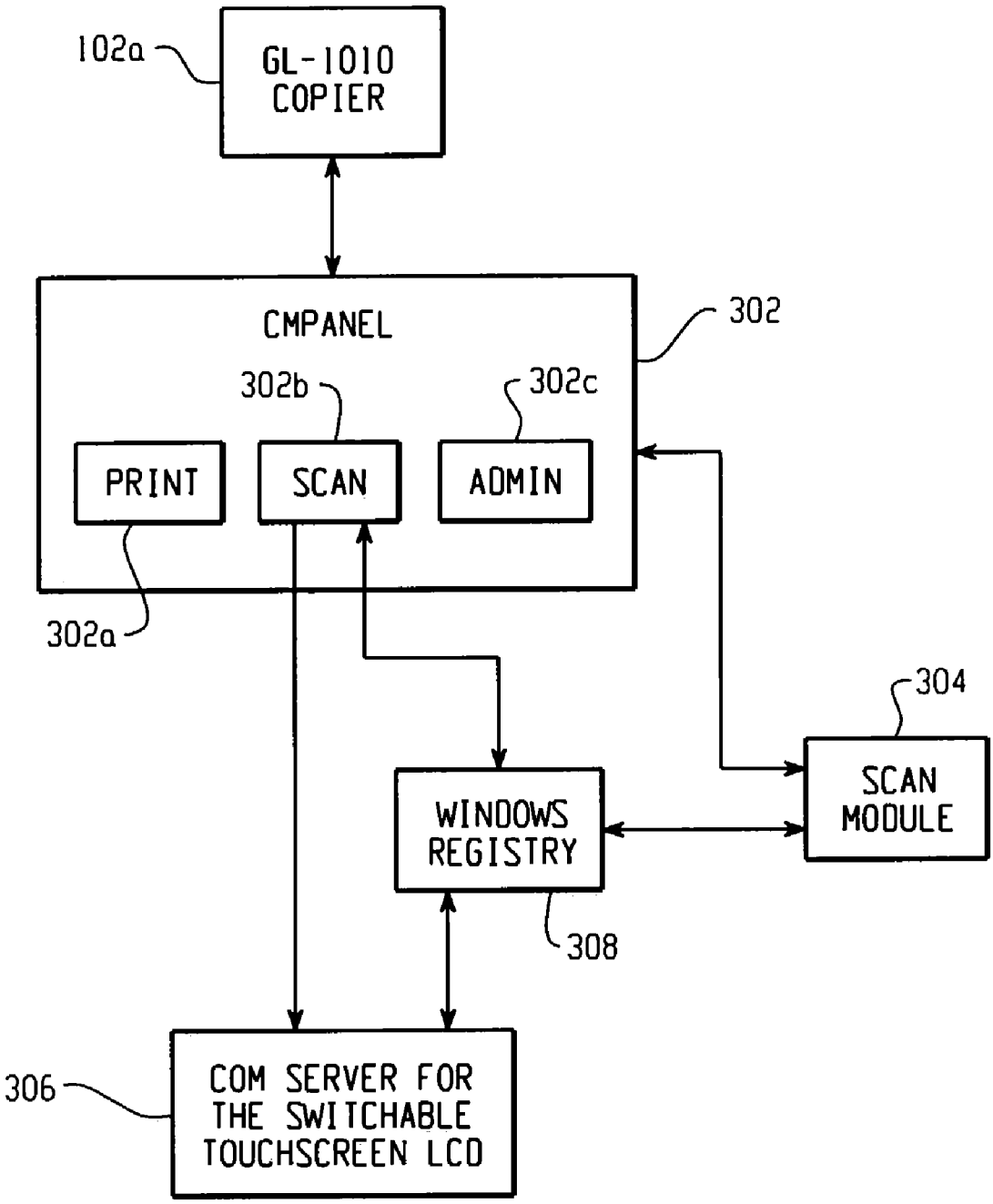
FIG. 3 is a block diagram of the software components of the present invention.

In a preferred embodiment, the image processing apparatus 100 comprises a controller 102*a* (FIG. 3), and a scanner coupled to the controller 102*a*. The controller 102*a* further comprises a component object module for communicating between the controller and a user interface, and causes the user interface to be displayed on the external video monitor 104, as shown in FIG. 3 The component object module user interface (COM) server 306 is in the same level as CMPanel 302 and CMScan 304 inside the controller 102*a*. The COM 306 contains the user interface itself. The COM 306 talks to CMPanel 302 and CMScan 304 via the operating system registries 308 and COM interfaces. Thus, the component object module processes commands which are input via the touchscreen monitor 104. The component object interface receives input from the external monitor 104 and communicates the input to the controller 102*a*. The operating system service, CMPanel 302 communicates with the user interface via a component object model interface. The operating system service posts in the operating system registry 308 its current event or state, such as a button is pushed on the registry keys. The operating system service contains a print function 302*a*, a scan function 302*b*, and an administration function 302*c*. Changes made in the administration function 302*c* are sent direction to the Scan Module (or CMScan) 304 and then to the Windows Registry 308. The CMScan 304 is an interface between the scanner and the controller 102*a*. Whereas, changes made in the Scan function 302*b* are sent directly to the Windows Registry 308. Then, when an image is scanned by the scanner, a scanned image is created, the scanned image is stored by the controller. The component object module then causes the scanned image to be displayed on the external monitor 104.

Figure 6:
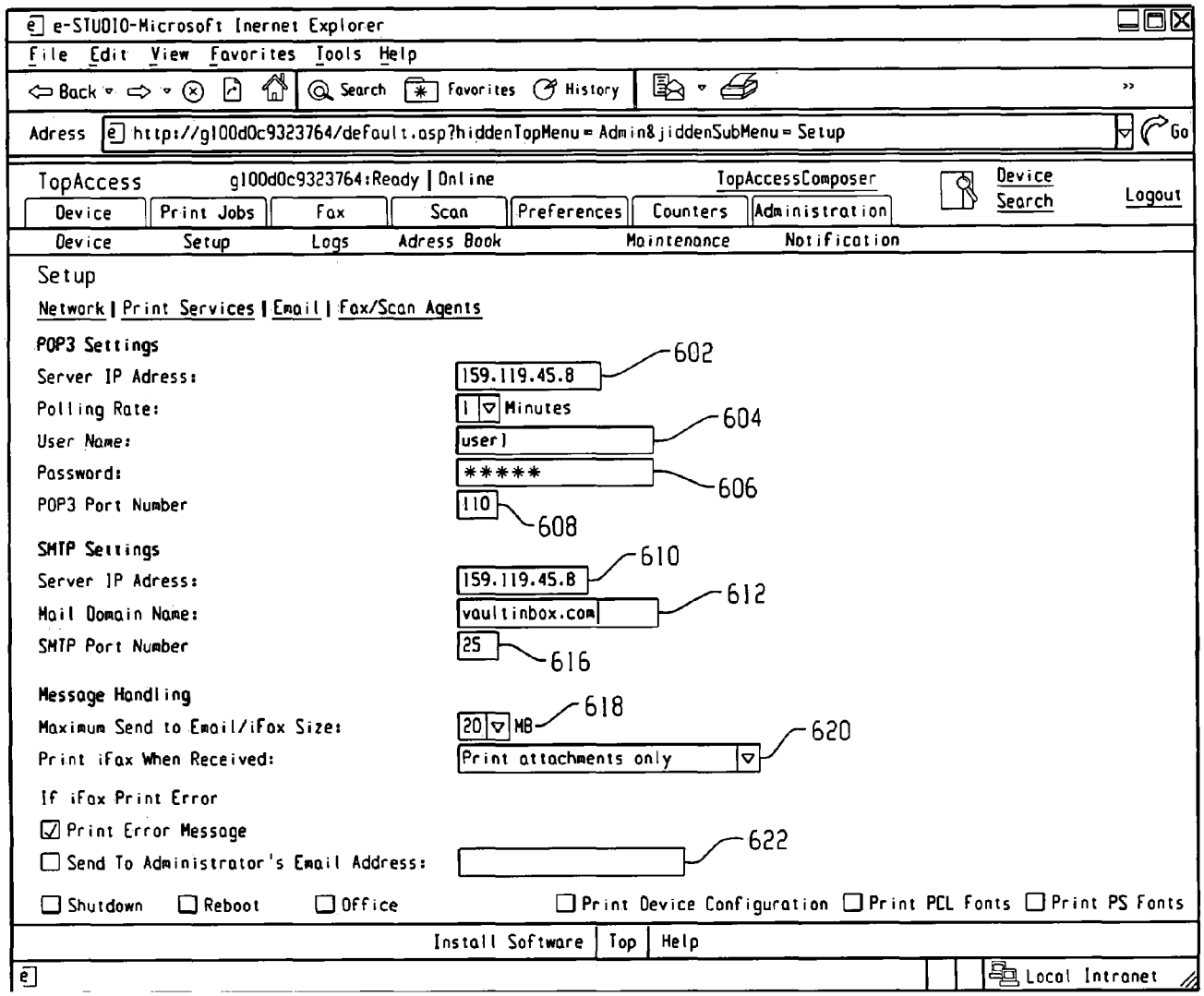
FIG. 6 is a front view of the administration setup screen on the touch screen of the present invention.

In operation, the email address/account information must be set up before using the scan to email operation on the copier. This can be accomplished by logging in as an Administrator. A user must click "Administrator tab", then "setup", and "email," which will display the Administration Setup Screen 600, as shown in FIG. 6. A user must then fill out the following information: server IP address 602, user name 604, password 606, POP3 Port Number 608, server IP address 610, mail domain name 612, SMTP Port Number 616, maximum send to email/fax size 618, print fax when received 620, and send to administrator's email address 622.

Figure 7:
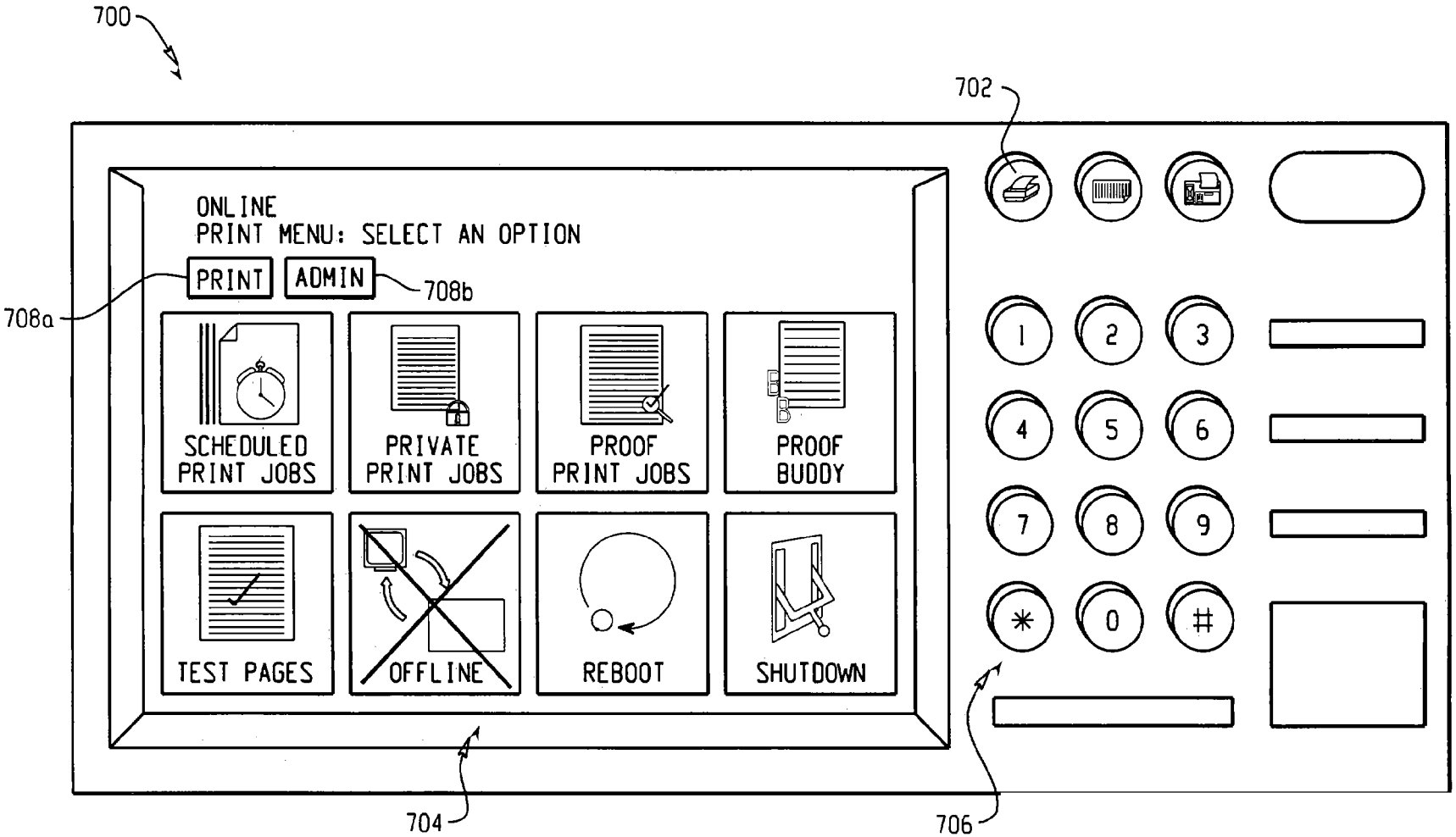
FIG. 7 is a front view of the copier's panel of the present invention.

Then, to turn on the Scanning screen on the external monitor 104, a user must click on the "printer/network" hard button 702 on the copier's panel 700, as shown in FIG. 7. The copier's panel 700 also includes a print button 708*a*, an administration button 708*b*, a keypad 706, and function keys 704, such as reboot, shutdown, and proof print jobs, etc.

Figure 8:
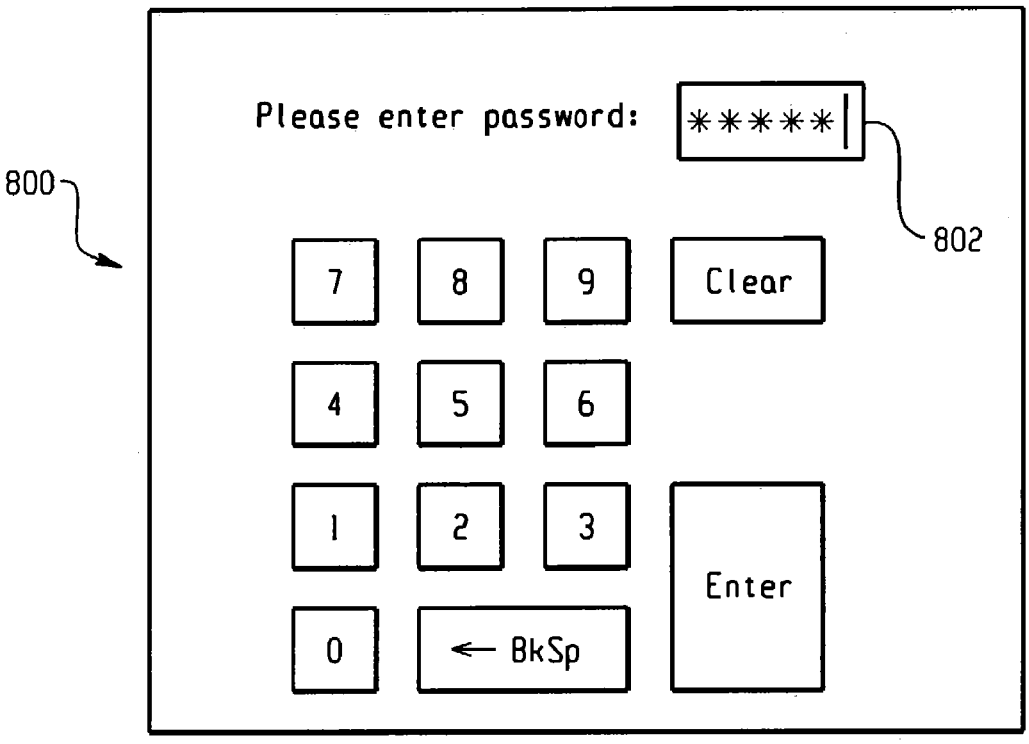
FIG. 8 is a front view of the password screen on the touch screen of the present invention.
Figure 9:
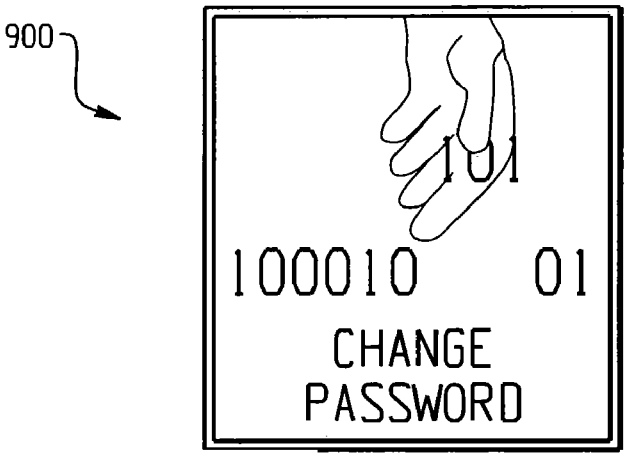
FIG. 9 is a front view of the change password icon on the touch screen of the present invention.

The touchscreen external monitor 104 then displays the password screen 800, as shown in FIG. 8. A user then enters the password in the space provided 802. The apparatus 100 is equipped with a default password, but administration can change the setting by using the copier's panel 700 and clicking on the "administration" button 708*b*, then clicking on the "change password" icon 900, as shown in FIG. 9.

Figure 10:
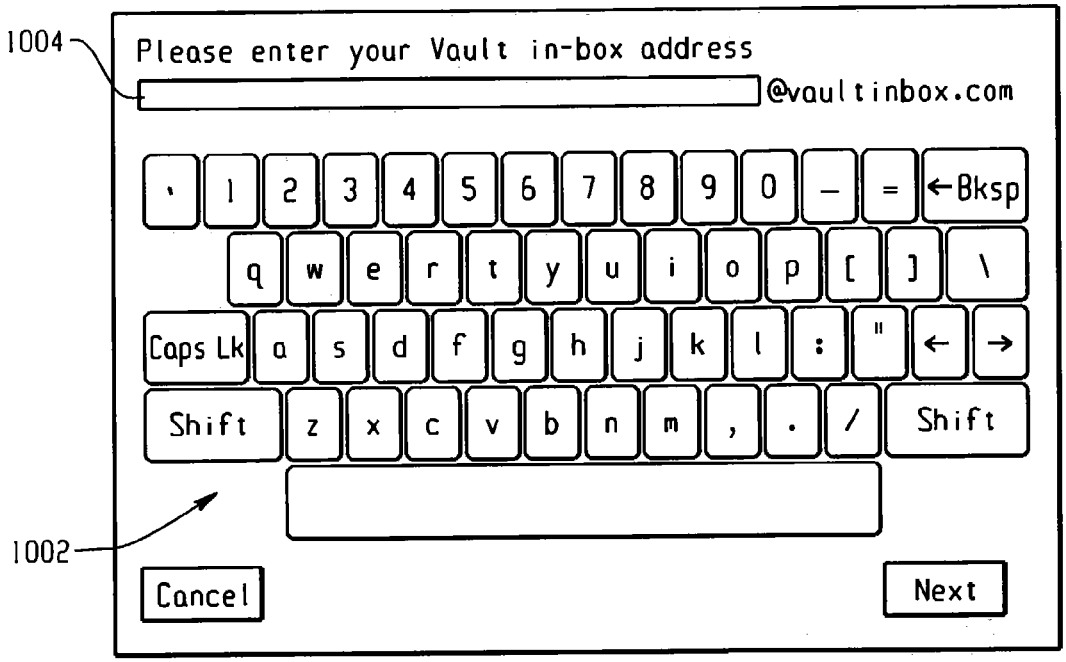
FIG. 10 is a front view of the email address screen on the touch screen of the present invention.
Figure 11:
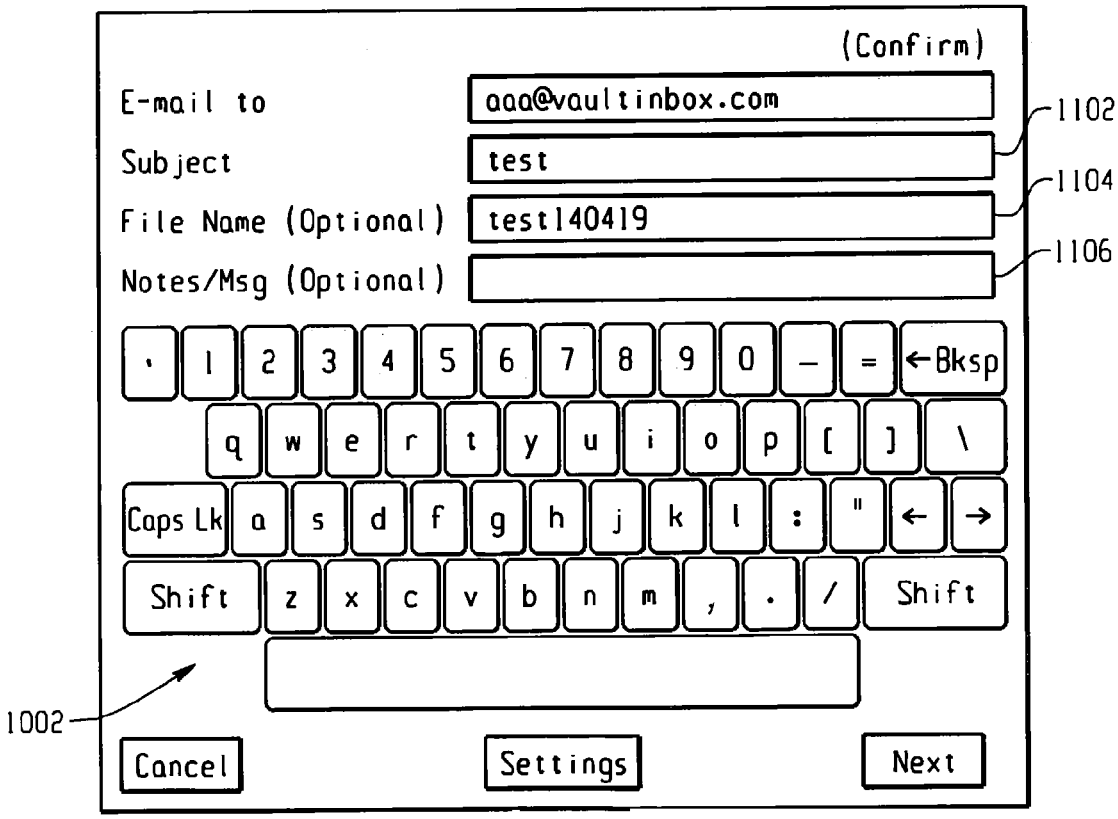
FIG. 11 is a front view of additional email information on the on the touch screen of the present invention.

Next, screens will show up for inputting the email address to send the scanned document, as shown in FIG. 10. A user will then fill out the appropriate information as instructed by each screen, using the keypad and function keys 1002. The email address entered will appear in the text box window 1004. Additional email address information can be inputted in subsequent screens, as shown in FIG. 11. Once again, a user will fill out the appropriate information using the keypad and function keys 1002, and input the subject of the document 1102, the file name 1104, and any notes 1106 on the screen. Then, the user clicks on the "settings" button to set the scan options and clicks on the "scan" button to start scanning.

Figure 12:
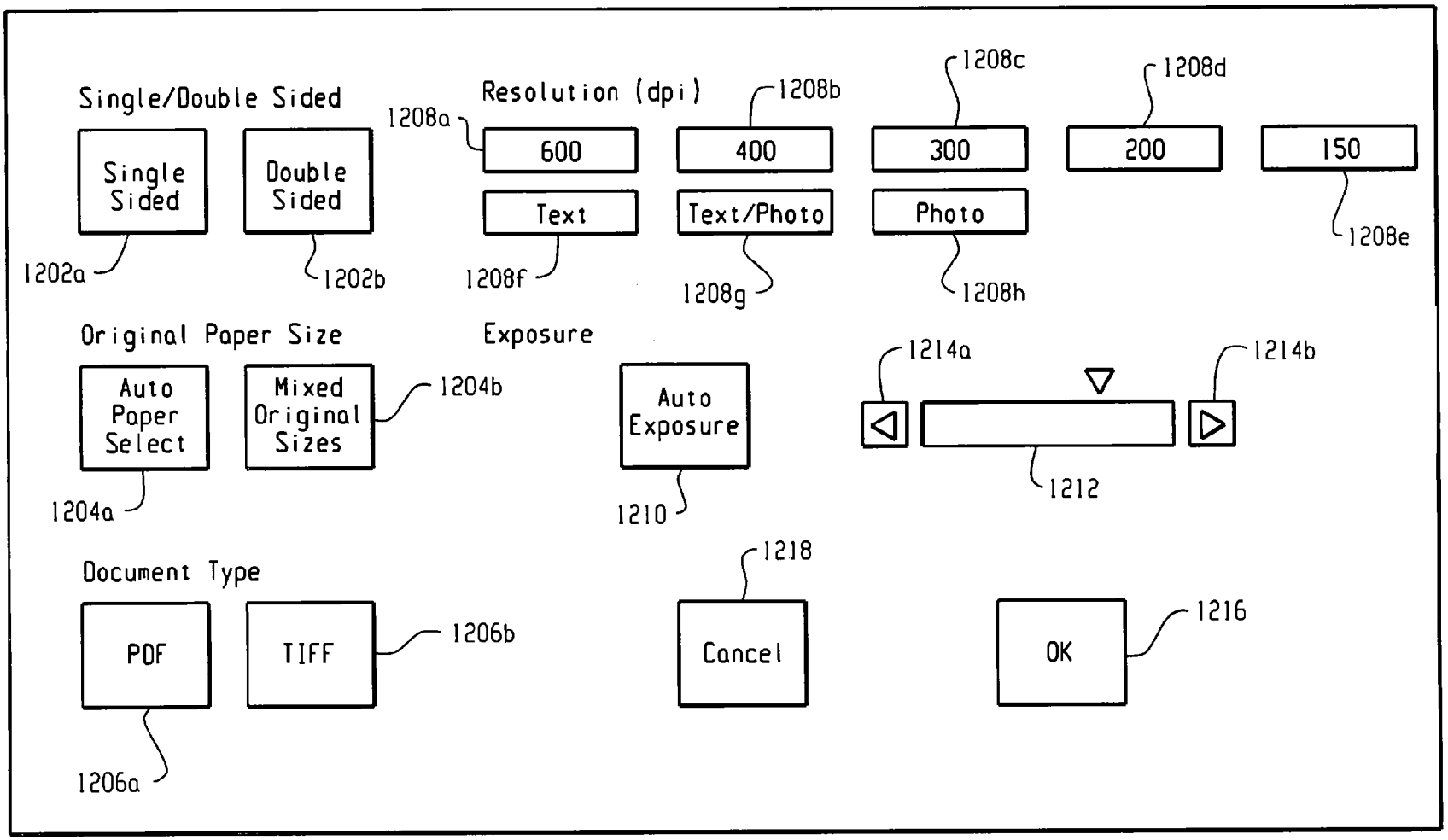
FIG. 12 is a front view of the settings screen on the touch screen of the present invention.

If the user clicks on the "settings" button, the settings screen is displayed, as shown in FIG. 12. A user can then set specific scan options, such as single-sided 1202*a* or double-sided 1202*b* copies, paper size 1204*a* and *b*, document type PDF 1206*a* or TIFF 1206*b*, resolution 1208*a, b, c, d, e, f, g*, or *h*, exposure 1210, and lighter or darker copies 1212 (via arrow keys 1214*a* and *b*). Then, a user can cancel 1218 the settings or save them by clicking on the "ok" button 1216.

Figure 2:
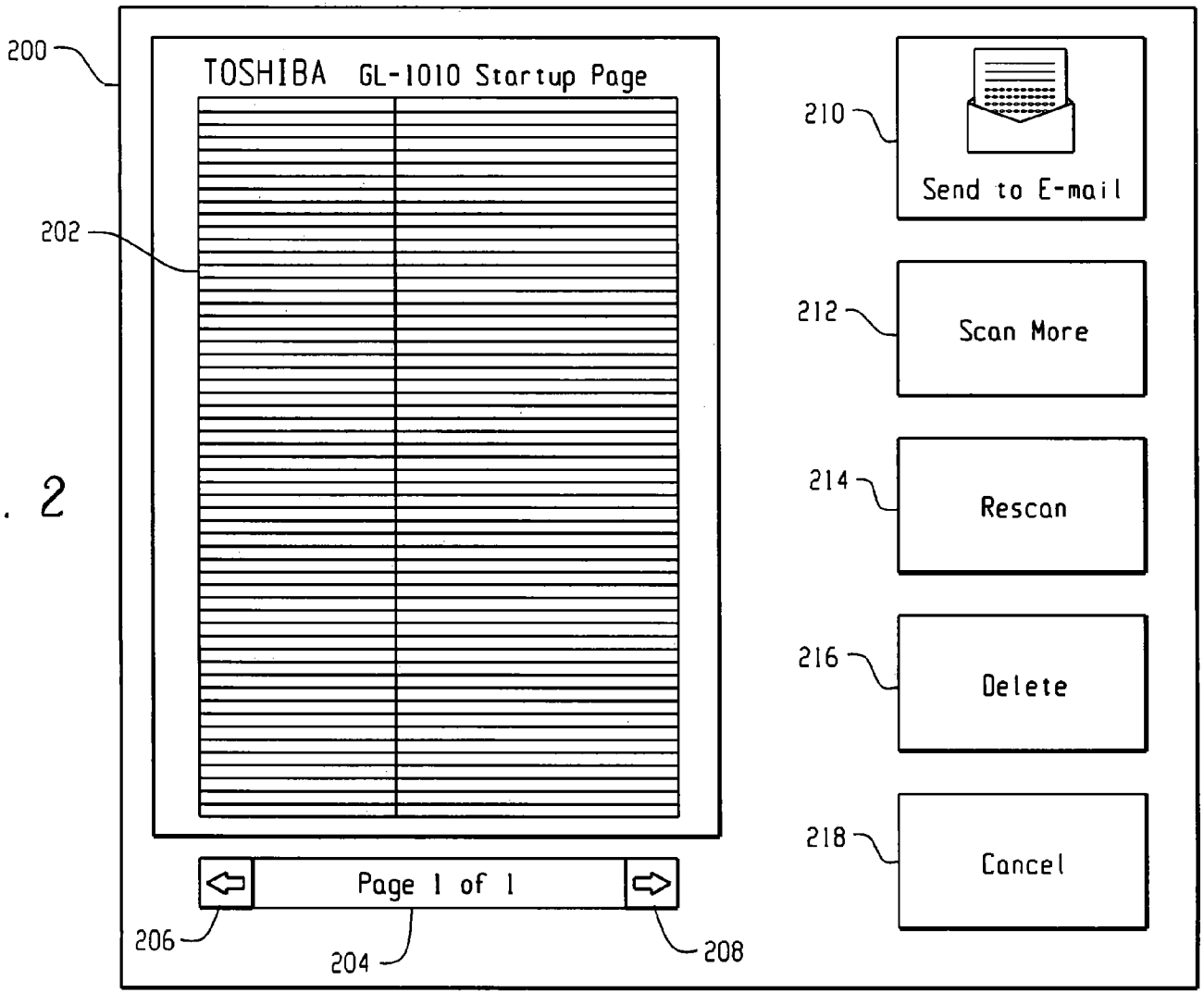
FIG. 2 is a front view of the monitor screen of the present invention.

Once this information is entered, the monitor screen 200 displays the scanned image 202 at real time, as shown in FIG. 2. A user can then perform various functions. A user can determine the number of pages the document contains 204, and can scroll through the document via the arrow keys 206 and 208. A user can then click on the "email" button 210 to send the whole document through email. If the user clicks on the "scan more" button 212 to append new images to the end of the document, or the "rescan" button 214 to replace the viewing image with new scanned images, the Settings screen will automatically display so that the user can configure the setting for each new scan. Finally, a user can click on the "delete" button 216 to delete the current page image or cancel 218 the scanned document altogether.

Figure 13:
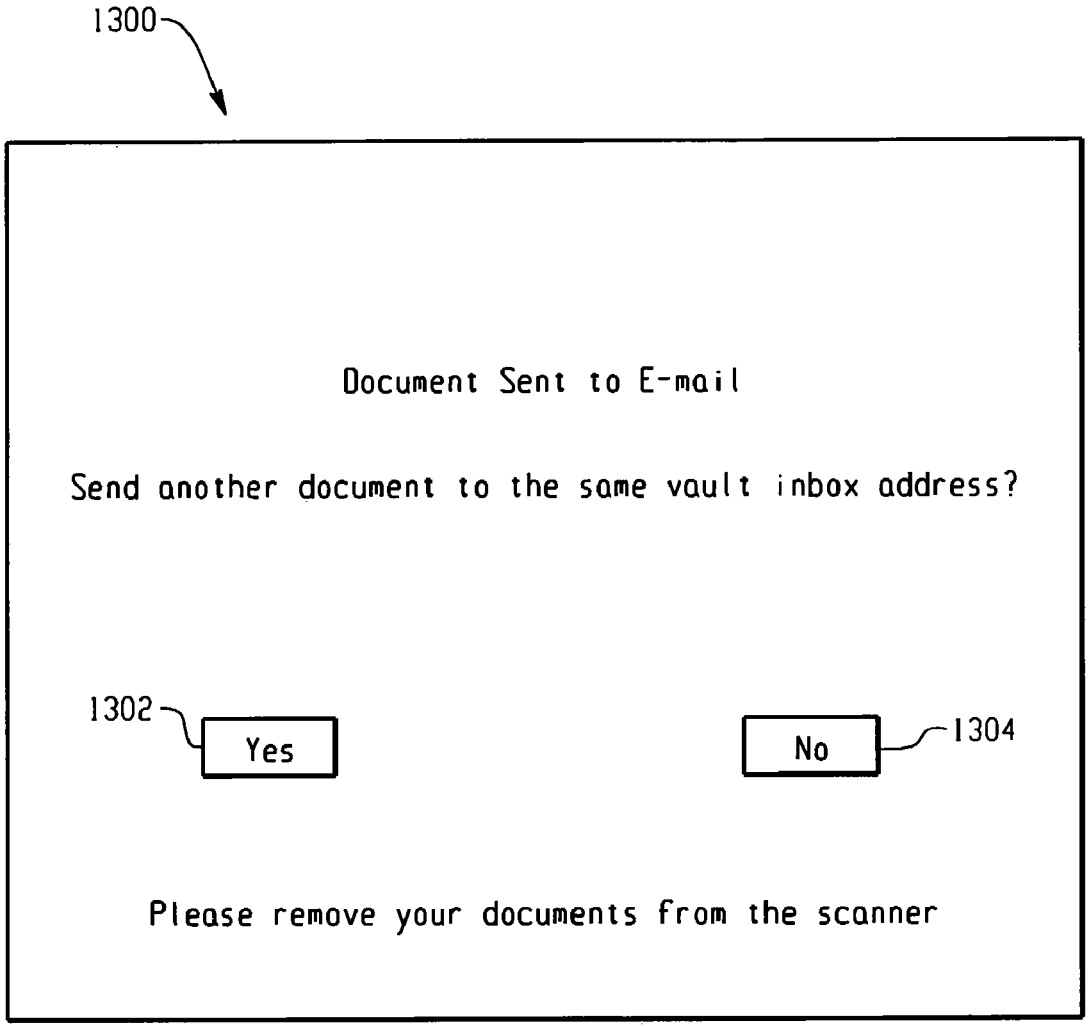
FIG. 13 is a front view of the confirmation screen when the scan job is complete on the touch screen of the present invention.

Finally, once the document has been scanned, the Scan Complete Confirmation Screen 1300 is displayed, as shown in FIG. 13. If a user intends to continue scanning using the same email address, he/she clicks on the "yes" button 1302. If a user does not intend to continue scanning, he/she clicks on the "no" button 1304, to finish the scanning process.

Figure 4A:
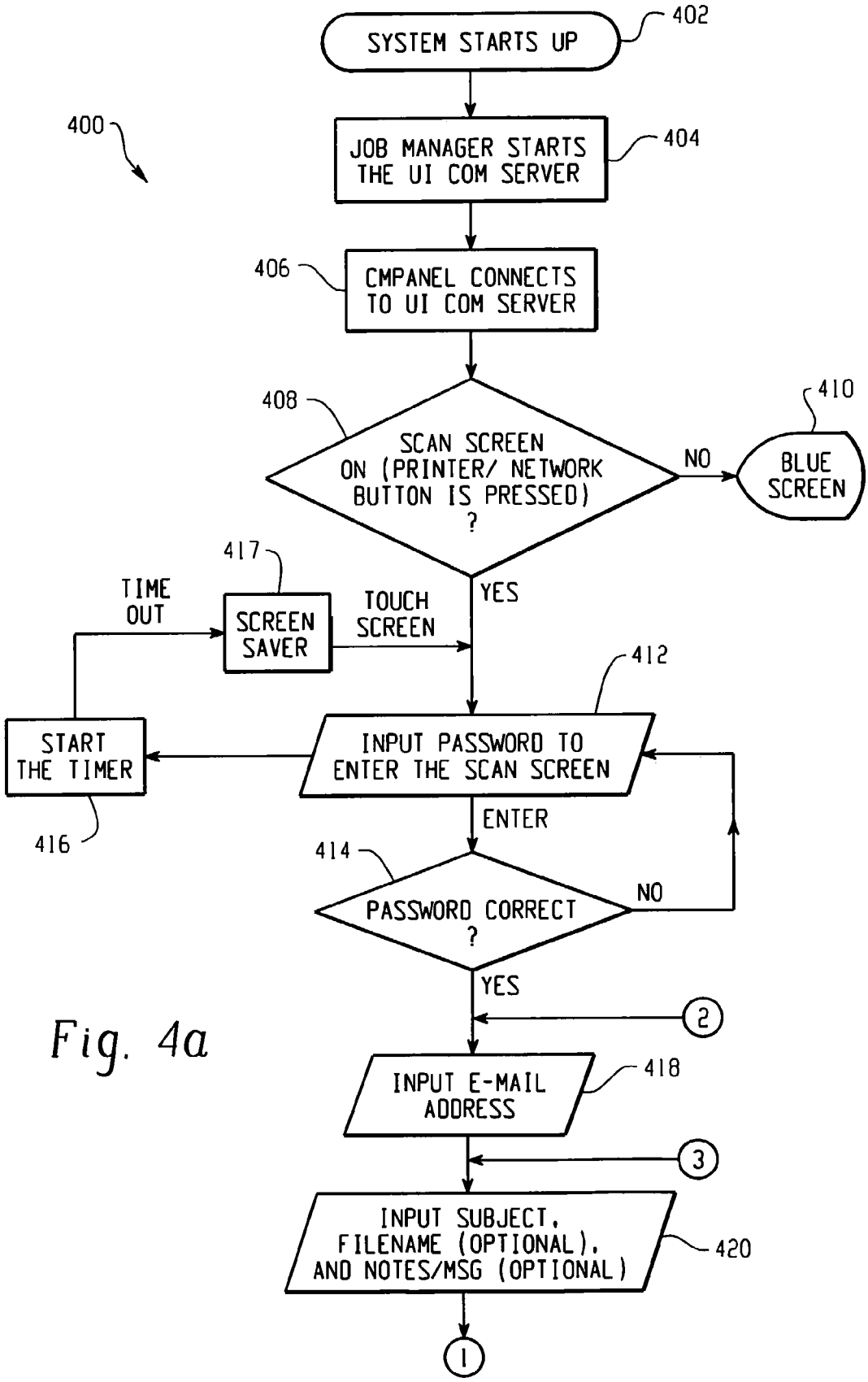
FIGS. 4*a* & *b* is a flow chart of the method of using the image processing apparatus.
Figure 4B:
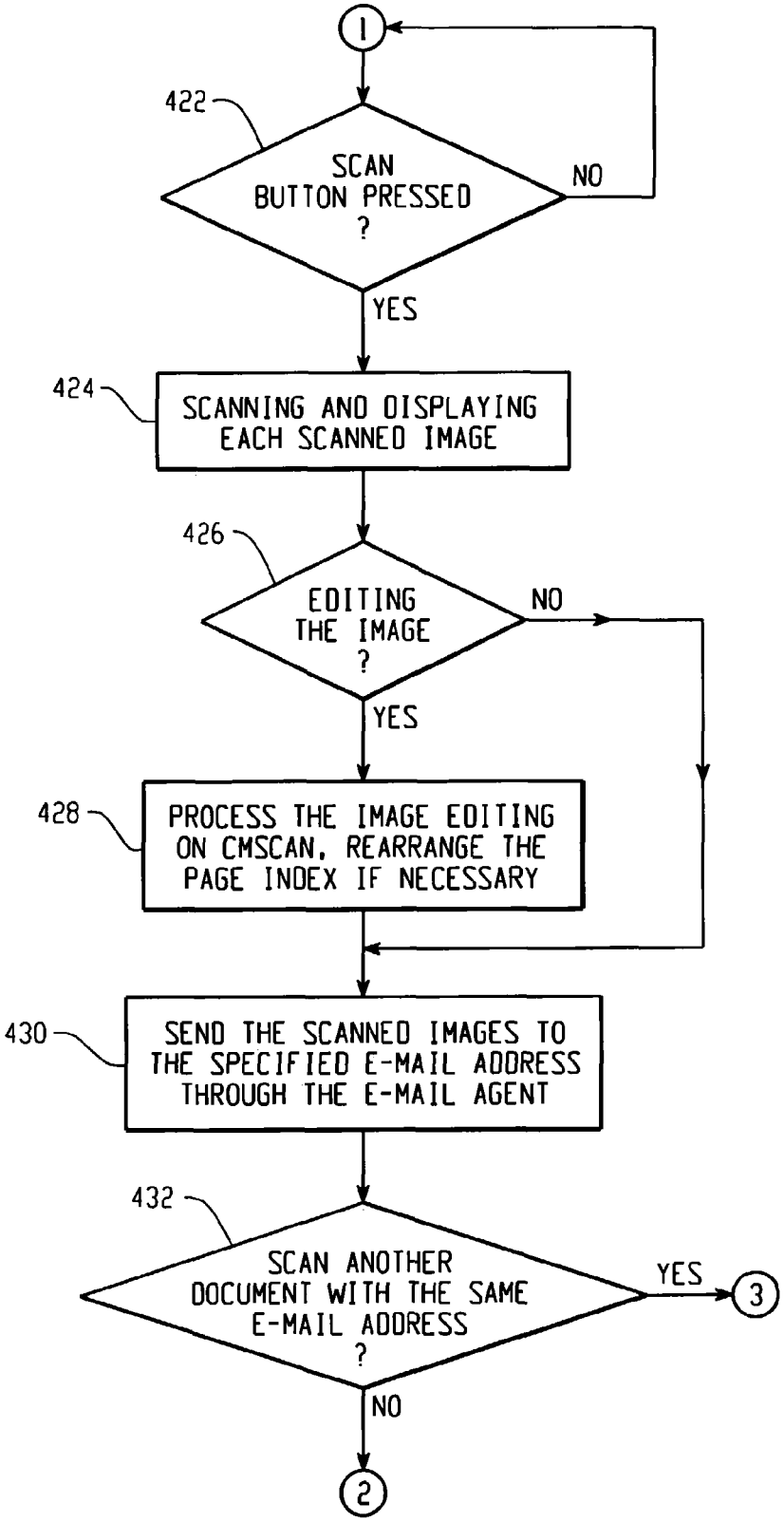

A flow chart showing the method of using the system 400 is shown in FIGS. 4*a* and *b*. The system starts up 402, then the job manager starts the user interface component object model server at step 404. Once this occurs, a CMPanel 302 connects to the user interface component object model server as shown at step 406. Then the scan screen is activated and the printer/network button must be pressed at step 408. If the printer/network button is not pressed, a blue screen appears as shown in step 410. If the printer/network button is pressed, then a user must input the password to enter the scan screen at step 412. At the same time step 412 begins, a timer trigger is started as shown in step 416. The timer trigger is ON whenever the user is in the login screen. If the user keys in a correct password then the timer trigger turns off. However, if a password is not keyed in within the allotted time, as shown in step 417 a screen saver mode is entered. In screen saver mode, a user can touch any part of the screen to return to the login screen. If at step 414 it is determined that the password entered is incorrect, the password screen remains and processing returns to step 412 wherein a user can enter another password. After a correct password has been keyed in, the user must input the email address of the location where the finished document will be sent as shown at step 418. Then, the user will input the subject, filename, and any notes on the document to be copied at step 420. Then, the scan button is pressed at step 422. The scan button must be pressed in order to proceed. Then each scanned image is scanned and displayed at step 424. Now, a user is able to edit the scanned image at step 426. If the user chooses not to edit the image, then the scanned images are sent to the specified email address through the email agent at step 430. If the user chooses to edit the image, then the image is edited on the CmScan 304 and the page index is rearranged, if necessary at step 428. Once the image is edited, it is then sent to the specified email address through the email agent at step 430. Then, the user has the option of scanning another document with the same email address at step 432 or entering another email address.

Figure 5:
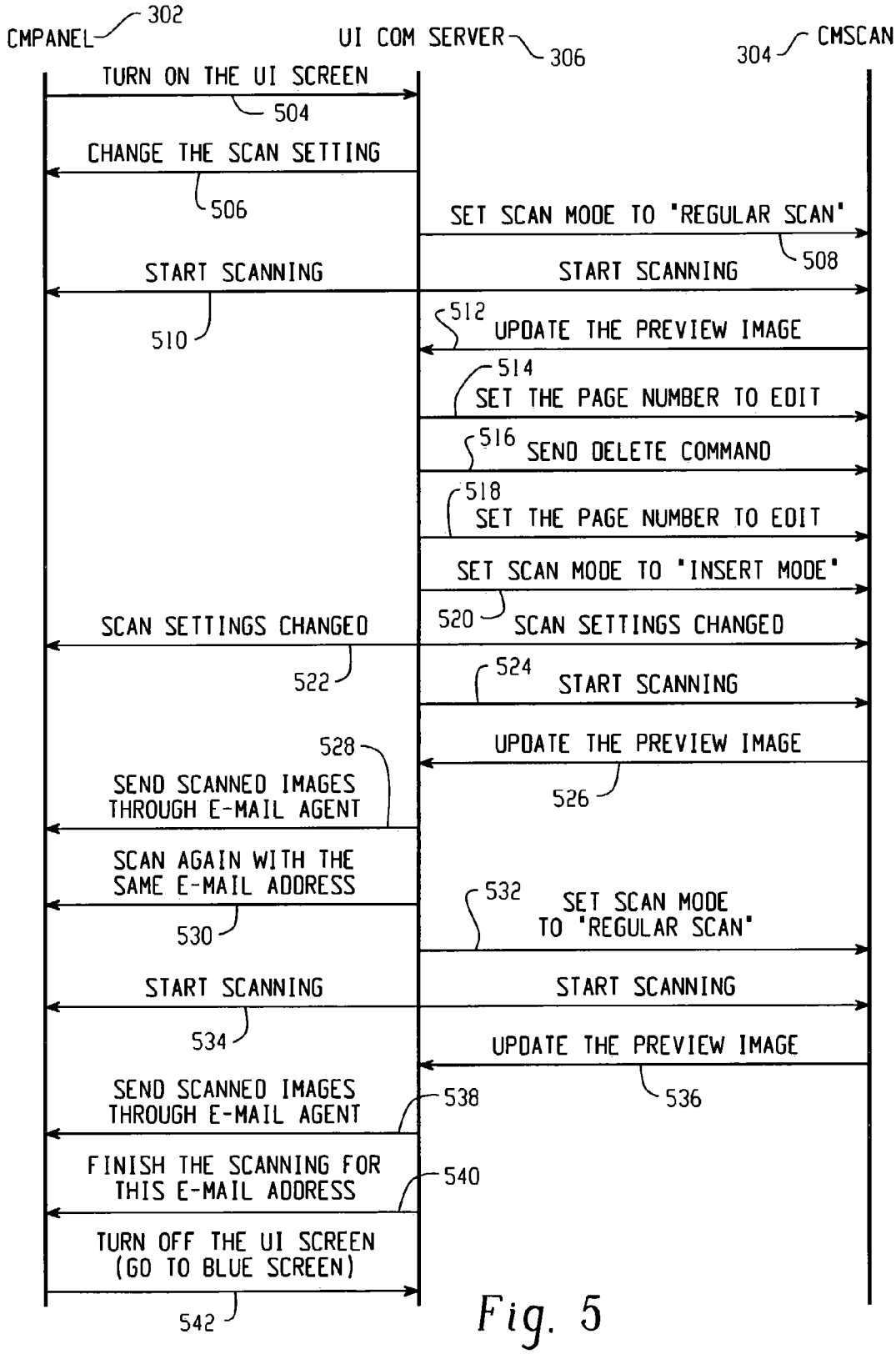
FIG. 5 is an event flow diagram showing the interaction between the various software modules of the present invention.

An event flow diagram showing the interaction between the various software modules is shown in FIG. 5. The COM server 306 is capable of communicating with CMPanel 302 and CMScan 304 either individually or simultaneously. Once the CMPanel 302 is activated, it tells the user interface component object module (COM) server 306 to turn on the user interface screen 504. Then, if a user wants to change the scan settings at step 506, the user interface COM server tells the CM Panel to change the settings. If the user wants to set scan mode to "regular scan" at step 508, the user interface COM server 306 tells the CMScan 304 to set the scan mode. Then, the user interface COM server 306 tells both the CMPanel 302 and CM Scan 304 to start scanning at step 510. Once scanning begins, the CMScan 304 updates the preview image at step 512 to the user interface COM server 306. Then, the user interface COM server tells 306 the CMScan 304 to set the page number to edit at step 514, send delete commands at step 516, set the page numbers to edit at step 518, and set scan mode to "insert mode" at step 520. Once this is completed, the user interface COM server tells 306 both the CMPanel 302 and CMScan 304 that the scan settings changed 522. Then, the user interface COM server 306 tells the CMScan 304 to start scanning at step 524. Once scanning begins, the CMScan 304 updates the preview image at step 526 to the user interface COM server 306. Then the user interface COM server tells 306 the CMPanel 302 to send scanned images through the email agent at step 528 and/or scan again with the same email address at step 530. The user interface COM server 306 also tells the CMScan 304 to set the scan mode to "regular scan" at step 532. Then, the user interface COM server 304 tells both the CMPanel 302 and CMScan 304 to start scanning at step 534. Once scanning begins, the CMScan 304 updates the preview image at step 536 to the user interface COM server 306. Then, the user interface COM server 306 tells the CMPanel 302 to send scanned images through the email agent at step 538 and/or finish the scanning for this email address at step 540. Finally, the CM Panel tells the user interface COM server to turn off the user interface screen and go to a blue screen 542.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of the ordinary skill in the art to utilize the invention in various embodiments and with various modifications as are suited to the particular use contemplated. All such modifications and variations are within the scope of the invention as determined by the appended claims when interpreted in accordance to the breadth to which they are fairly, legally and equitably entitled.

What is claimed is:

1. A document processor interface comprising:

a user interface, including a touch-sensitive video display;

means adapted for receiving data representative of an associated, electronic document;

means adapted for generating a document image, of at least a portion of the electronic document, on a first portion of the user interface;

means adapted for generating at least one user input image on the touch-sensitive video display, which user input image includes indicia representative of a plurality of available document processing functions including scanning, copying, printing, and facsimile transmission, the user input image being separated from the document image on the user interface;

means adapted for receiving from the touch sensitive video display selection data representative of user-selection of at least one selected document processing function associated with a user input image;

means adapted for generating a graphical representation of a an alphanumeric keyboard on a portion the touch sensitive video display;

means adapted for receiving user data representative of an identity of an associated user in accordance with input from the keyboard portion;

means adapted for receiving, from the touch sensitive video display, routing data representative of a selected mode for routing the electronic document including facsimile transmission and electronic mail transmission;

means adapted for receiving destination data from the keyboard portion representative of a desired electronic mail address corresponding to selected electronic mail transmission and facsimile number corresponding to selected facsimile transmission for an output of a selected document processing operation corresponding to received routing data; and means adapted for communicating, to an associated document processor, the user selection data so as to commence a document processing operation on the electronic document in accordance therewith.

2. The document processor interface of claim 1 wherein the document image generated on the first portion of the user interface comprises an actual depiction of the associated document.

3. The document processor interface of claim 1 wherein the means adapted for generating a document image and at least one user input image comprises a component object module.

4. The document processor interface of claim 1 wherein the user interface includes a color LCD touchscreen monitor.

5. The document processor interface of claim 4 wherein the user selection data is received via input via the color LCD touchscreen monitor.

6. The document processor interface of claim 4 wherein the color LCD touchscreen monitor is at least a 12.1 inch monitor.

7. A method for interfacing with a document processor comprising the steps of:

receiving data representative of an associated, electronic document;

generating a document image, of at least a portion of the electronic document, on a first portion of a user interface;

generating at least one user input image on a touch-sensitive video display, portion of the user interface, which user input image includes indicia representative of a plurality of available document processing functions including scanning, copying, printing, and facsimile transmission, the user input image being separated from the document image on the user interface;

receiving selection data representative of user-selection of at least one selected document processing function associated with a user input image;

generating a graphical representation of an alphanumeric keyboard on a portion the touch sensitive video display;

receiving user data representative of an identity of an associated user in accordance with input from the keyboard portion;

receiving, from the touch sensitive video display, routing data representative of a selected mode for routing the electronic document including facsimile transmission and electronic mail transmission;

receiving destination data from the keyboard portion representative of a desired electronic mail address corresponding to selected electronic mail transmission and facsimile number corresponding to selected facsimile transmission for an output of a selected document processing operation corresponding to received routine data; and communicating, to an associated document processor, the user selection data so as to commence a document processing operation on the electronic document in accordance therewith.

8. The method for interfacing with a document processor of claim 7 wherein the document image generated on the first portion of the user interface comprises an actual depiction of the associated document.

9. The method for interfacing with a document processor of claim 7 wherein step of generating a document image and at least one user input image is performed via a component object module.

10. The method for interfacing with a document processor of claim 7 wherein the user interface includes a color LCD touchscreen monitor.

11. The method for interfacing with a document processor of claim 10 wherein the user selection data is received via input via the color LCD touchscreen monitor.

12. The method for interfacing with a document processor of claim 10 wherein the color LCD touchscreen monitor is at least a 12.1 inch monitor.

13. A computer-readable medium of instructions with computer-readable instructions stored thereon for interfacing with a document processing comprising:

instructions for receiving data representative of an associated, electronic document;

instructions for generating a document image, of at least a portion of the electronic document, on a first portion of a user interface;

instructions for generating at least one user input image on a touch-sensitive video display, portion of the user interface, which user input image includes indicia representative of a plurality of available document processing functions including scanning, copying, printing, and facsimile transmission, the user input image being separated from the document image on the user interface;

instructions for receiving selection data representative of user-selection of at least one selected document processing function associated with a user input image;

instructions for generating a graphical representation of an alphanumeric keyboard on a portion the touch sensitive video display;

instructions for receiving user data representative of an identity of an associated user in accordance with input from the keyboard portion;

instructions for receiving, from the touch sensitive video display, routing data representative of a selected mode for routing the electronic document selected from the group of facsimile transmission and electronic mail transmission;

instructions for receiving destination data from the keyboard portion representative of a desired electronic mail address corresponding to selected electronic mail transmission and facsimile number corresponding to selected facsimile transmission for an output of a selected document processing operation corresponding to the received routing data; and instructions for communicating, to an associated document processor, the user selection data so as to commence a document processing operation on the electronic document in accordance therewith.

14. The computer-readable medium of instructions with computer-readable instructions stored thereon for interfacing with a document processor of claim 13 wherein the document image generated on the first portion of the user interface comprises an actual depiction of the associated document.

15. The computer-readable medium of instructions with computer-readable instructions stored thereon for interfacing with a document processor of claim 13 wherein the user interface includes a color LCD touchscreen monitor and wherein the user selection data is received via input via the color LCD touchscreen monitor.

16. A computer-implemented method for interfacing with a document processing comprising:

receiving data representative of an associated, electronic document;

generating a document image, of at least a portion of the electronic document, on a first portion of a user interface;

generating at least one user input image on a touch-sensitive video display, portion of the user interface, which user input image includes indicia representative of a plurality of available document processing functions including scanning, copying, printing, and facsimile transmission, the user input image being separated from the document image on the user interface;

receiving selection data representative of user-selection of at least one selected document processing function associated with a user input image;

generating a graphical representation of an alphanumeric keyboard on a portion the touch sensitive video display;

receiving user data representative of an identity of an associated user in accordance with input from the keyboard portion;

receiving, from the touch sensitive video display, routing data representative of at a selected mode for routing the electronic document including facsimile transmission and electronic mail transmission;

receiving destination data from the keyboard portion representative of a desired electronic mail address corresponding to selected electronic mail transmission and facsimile number corresponding to selected facsimile transmission for an output of a selected document processing operation corresponding to the received routing data; and communicating, to an associated document processor, the user selection data so as to commence a document processing operation on the electronic document in accordance therewith.

17. The computer-implemented method for interfacing with a document processor of claim 13 wherein the document image generated on the first portion of the user interface comprises an actual depiction of the associated document.

18. The computer-implemented method for interfacing with a document processor of claim 13 wherein the user interface includes a color LCD touchscreen monitor and wherein the user selection data is received via input via the color LCD touchscreen monitor.

* * * * *